US007315286B2

(12) United States Patent
Lee et al.

(10) Patent No.: US 7,315,286 B2
(45) Date of Patent: Jan. 1, 2008

(54) ANTENNA APPARATUS FOR PORTABLE TERMINAL

(75) Inventors: Jae-Ho Lee, Gumi-si (KR); Yeong-Moo Ryu, Gumi-si (KR); Hark-Sang Kim, Daegu (KR); Ji-Hwa Kim, Gyeongsangbuk-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 18 days.

(21) Appl. No.: 11/342,628

(22) Filed: Jan. 31, 2006

(65) Prior Publication Data

US 2007/0030202 A1 Feb. 8, 2007

(30) Foreign Application Priority Data

Aug. 4, 2005 (KR) ..... 10-2005-0071312

(51) Int. Cl.
*H01Q 1/24* (2006.01)

(52) U.S. Cl. ..... 343/702; 343/806; 343/895

(58) Field of Classification Search ..... 343/700 MS, 343/702, 795, 895, 806
See application file for complete search history.

(56) References Cited

U.S. PATENT DOCUMENTS 5,136,303 A * 8/1992 Cho et al. ..... 343/718
6,181,282 B1 * 1/2001 Gans et al. ..... 343/700 MS
6,650,294 B2 * 11/2003 Ying et al. ..... 343/700 MS
6,657,593 B2 * 12/2003 Nagumo et al. ..... 343/700 MS
6,822,613 B2 * 11/2004 Kubota ..... 343/713
7,119,743 B2 * 10/2006 Iguchi et al. ..... 343/700 MS

FOREIGN PATENT DOCUMENTS

KR 2001-98511 11/2001
KR 2002-26361 4/2002

* cited by examiner

*Primary Examiner*—Tan Ho
(74) *Attorney, Agent, or Firm*—Roylance, Abrams, Berdo & Goodman, L.L.P.

(57) ABSTRACT

Provided is an antenna apparatus for a portable terminal including a first antenna pattern, and a second antenna pattern formed to correspond to the first antenna pattern, so that the second antenna provides a capacitive coupling along with the first pattern, thereby configuring a divergent type antenna with the second antenna pattern. The antenna apparatus configured in this manner comprises a pair of meander line antennas, whereby the antenna apparatus can efficiently suppress the generation of noise while being easily housed within the terminal. Furthermore, the antenna apparatus has an advantage of easily enhancing a specific absorption ratio (SAR) induced in a human body, which is an important factor for defining the function and quality of an antenna apparatus.

9 Claims, 5 Drawing Sheets

ANTENNA APPARATUS FOR PORTABLE TERMINAL

CROSS-REFERENCE TO RELATED PATENT APPLICATION

This application claims the benefit under 35 U.S.C. §119 (a) of Korean Patent Application 2005-71312, filed Aug. 4, 2005, in the Korean Intellectual Property Office, the entire disclosure of which is hereby incorporated by reference.

BACKGROUND OF THE INVENTION

1. Field of the Invention

The present invention relates to a portable terminal. More particularly, the present invention relates to an antenna apparatus for a portable terminal.

2. Description of the Related Art

In general, a portable terminal is an appliance for providing wireless user-to-user communication or user-to-service provider communication through one or more mobile communication base stations. A user can be provided with various content including anything from communications and short message services to mobile banking, TV broadcasting, online gaming, and video-on-demand services.

A portable terminal has an antenna apparatus for securing an acceptable good signal-receiving percentage or a good communication quality, despite the radio frequency propagation environment varying due to its surroundings. Antenna apparatuses provided in portable terminals differ in specifications, such as length, depending on the frequency bands used by the service providers that the portable terminals operate with.

Such antenna apparatuses may be classified into an internal type and an external type. An internal type antenna is provided within a housing of a portable terminal. An external type antenna protrudes outwardly from the housing. Exemplary internal type antennas include a meander line antenna, a loop antenna, an inverted L antenna, and a planar inverted F antenna (PIFA). Exemplary external type antennas include a whip antenna having an antenna element such as a helical antenna received in an antenna housing and a retractable/extendible antenna element installed on a terminal housing.

FIG. 1 is a perspective view showing an antenna 100 for a portable terminal according to the prior art. As shown in FIG. 1, the conventional antenna apparatus 100 is formed as a planar inverted F antenna (hereinafter, referred to as "PIFA antenna"). The PIFA antenna comprises an antenna pattern 102, an antenna base 101 formed of a synthetic resin on which the antenna is configured, a printed circuit board 103, and a power feed point 121 and ground 123 which are provided for the purpose of feeding power.

However, the construction of a conventional internal type antenna apparatus, such as a PIFA antenna, is limited in improving a specific absorption ratio induced in a human body (hereinafter, referred to as "SAR") because the current fed through the antenna apparatuses flows in one direction. In addition, the conventional internal type antenna deteriorates communications due to the generation of noise as well as the SAR.

Accordingly, there is a need for an improved internal type antenna apparatus that improves SAR and reduces noise so as to prevent deteriorated communications.

SUMMARY OF THE INVENTION

An aspect of the present invention is to address at least the above problems and/or disadvantages and to provide at least the advantages described below. Accordingly, an aspect of exemplary embodiments of the present invention is to provide an antenna apparatus for a portable terminal which can easily improve SAR while being housed within the terminal.

Another aspect of exemplary embodiments of the present invention is to provide an antenna apparatus for a portable terminal which can suppress the generation of noise while being housed within the terminal, thereby improving the communication quality of the terminal.

In order to achieve the above-mentioned aspect, there is provided an antenna apparatus for a portable terminal comprising a first antenna pattern, and a second antenna pattern adapted to correspond to the first antenna pattern, so that at least part of the second antenna and the first pattern are capacitively coupled, thereby configuring a divergent type antenna with the second antenna pattern.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
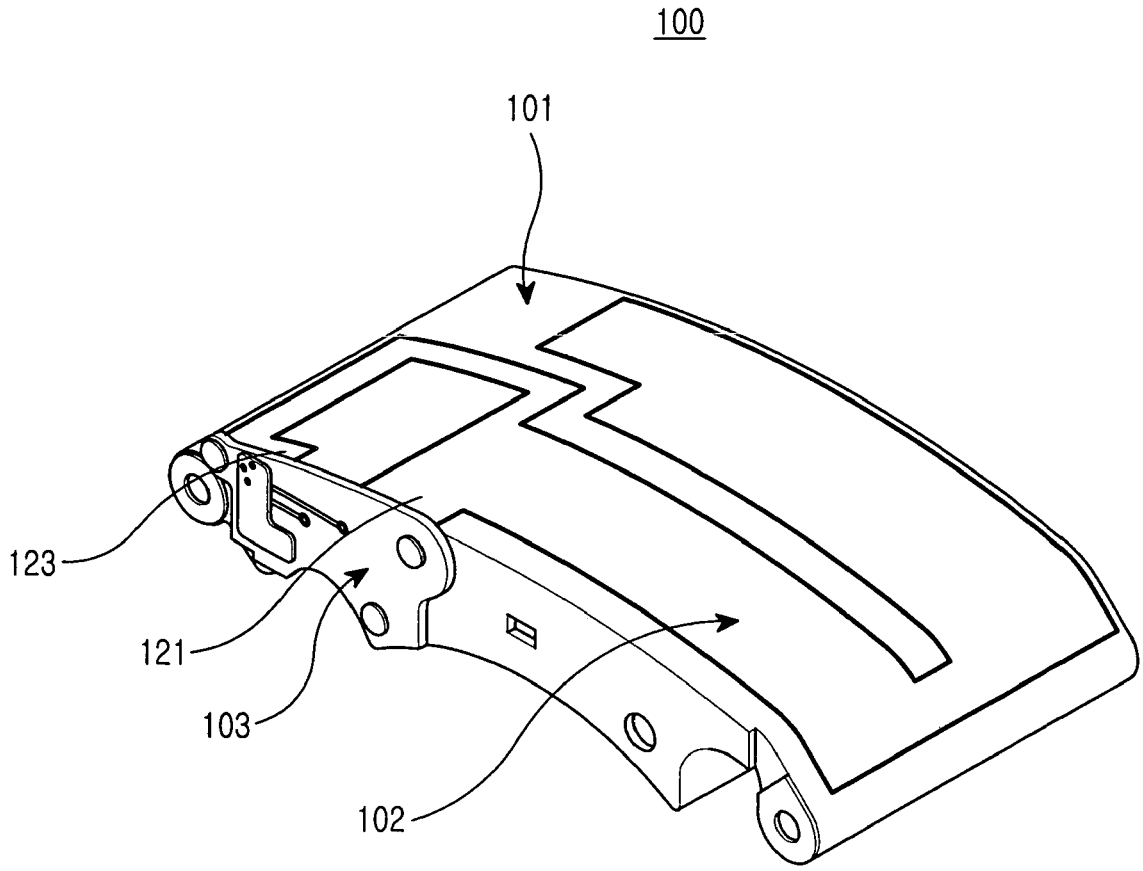
FIG.1 (PRIOR ART)
FIG. 1 is a perspective view showing a conventional antenna apparatus for a portable terminal.
Figure 2:
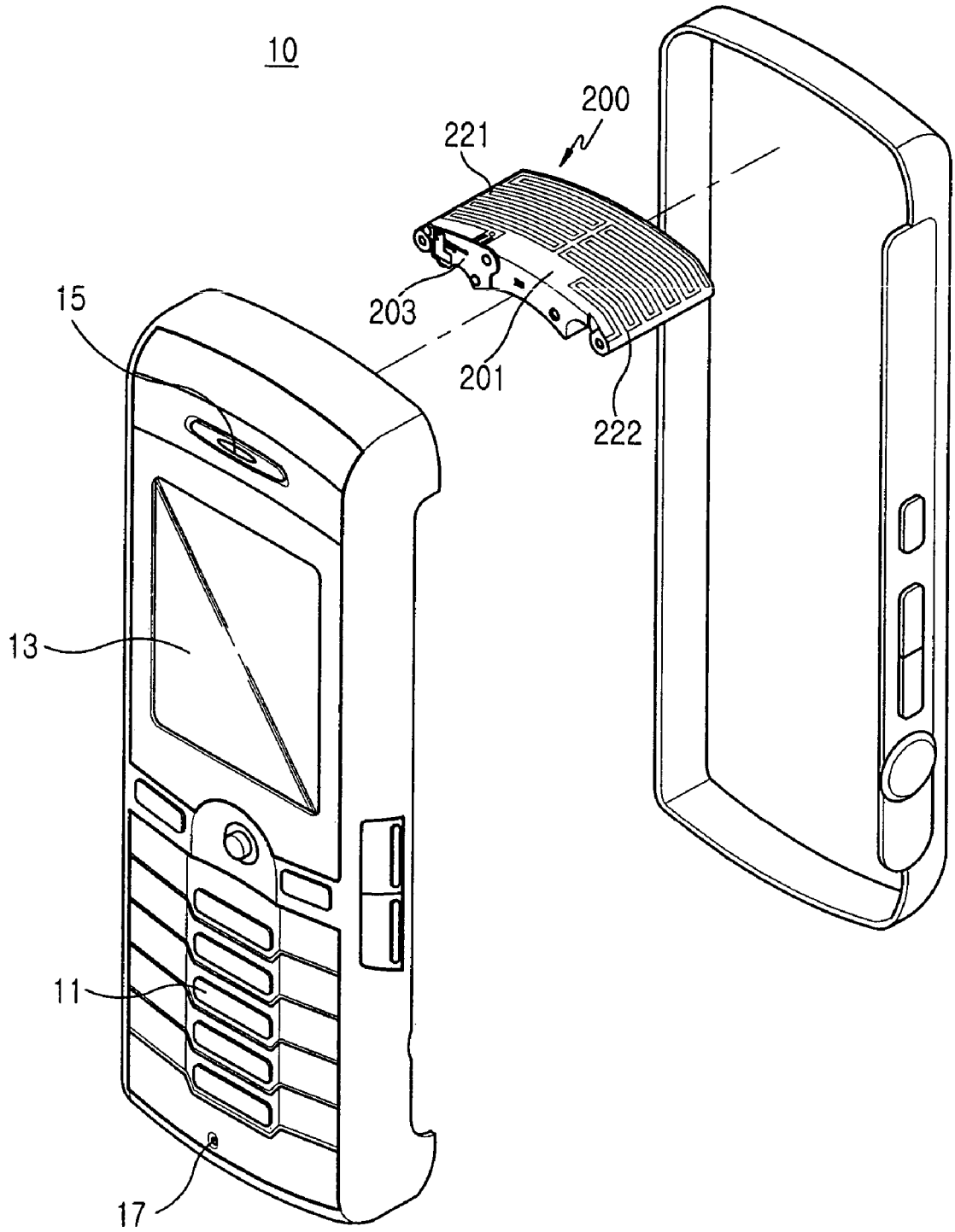
FIG. 2 is an exploded perspective view showing a portable terminal having an antenna apparatus according to an exemplary embodiment of the present invention.
Figure 3:
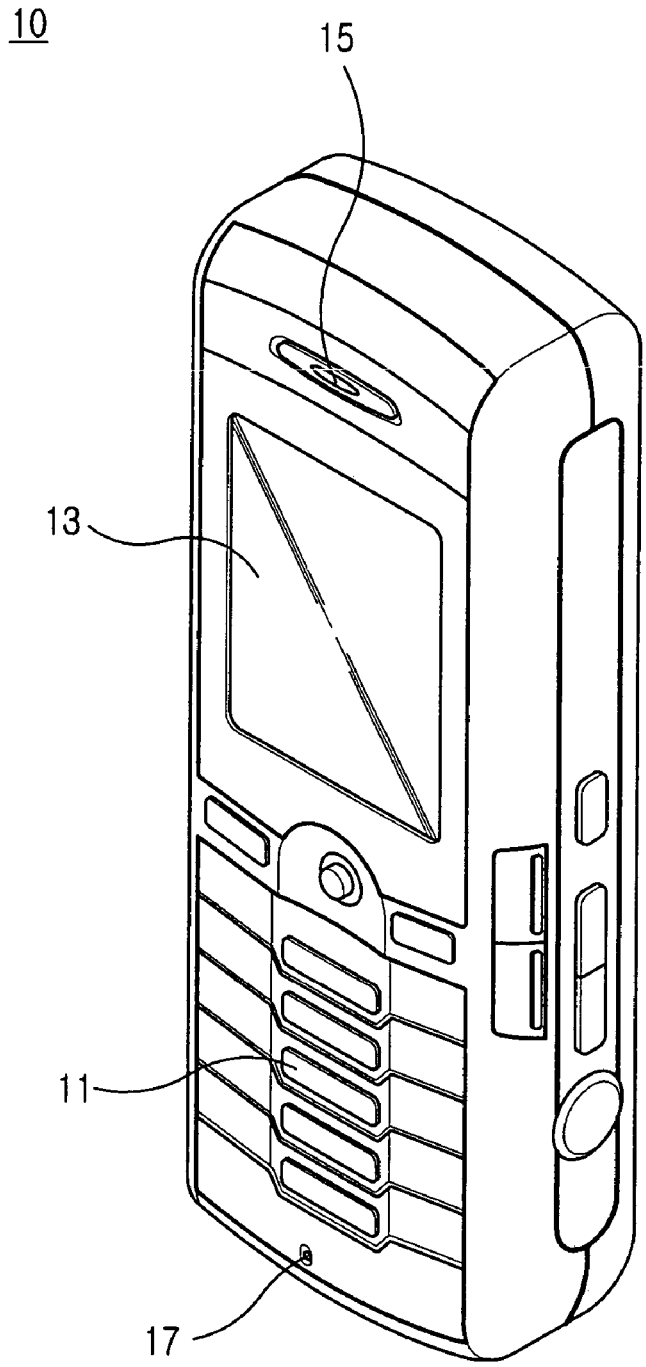
FIG. 3 is a perspective view showing the portable terminal of FIG. 2 in the assembled state.

Referring to FIGS. 2 and 3, a portable terminal 10 with an antenna apparatus 200 according to an exemplary embodiment of the present invention is a bar type terminal having installed in a single housing a key pad 11, a display device 13, a speaker 15 and a microphone 17. The antenna apparatus 10 is housed within the top portion of the housing of the terminal 10.

Figure 4:
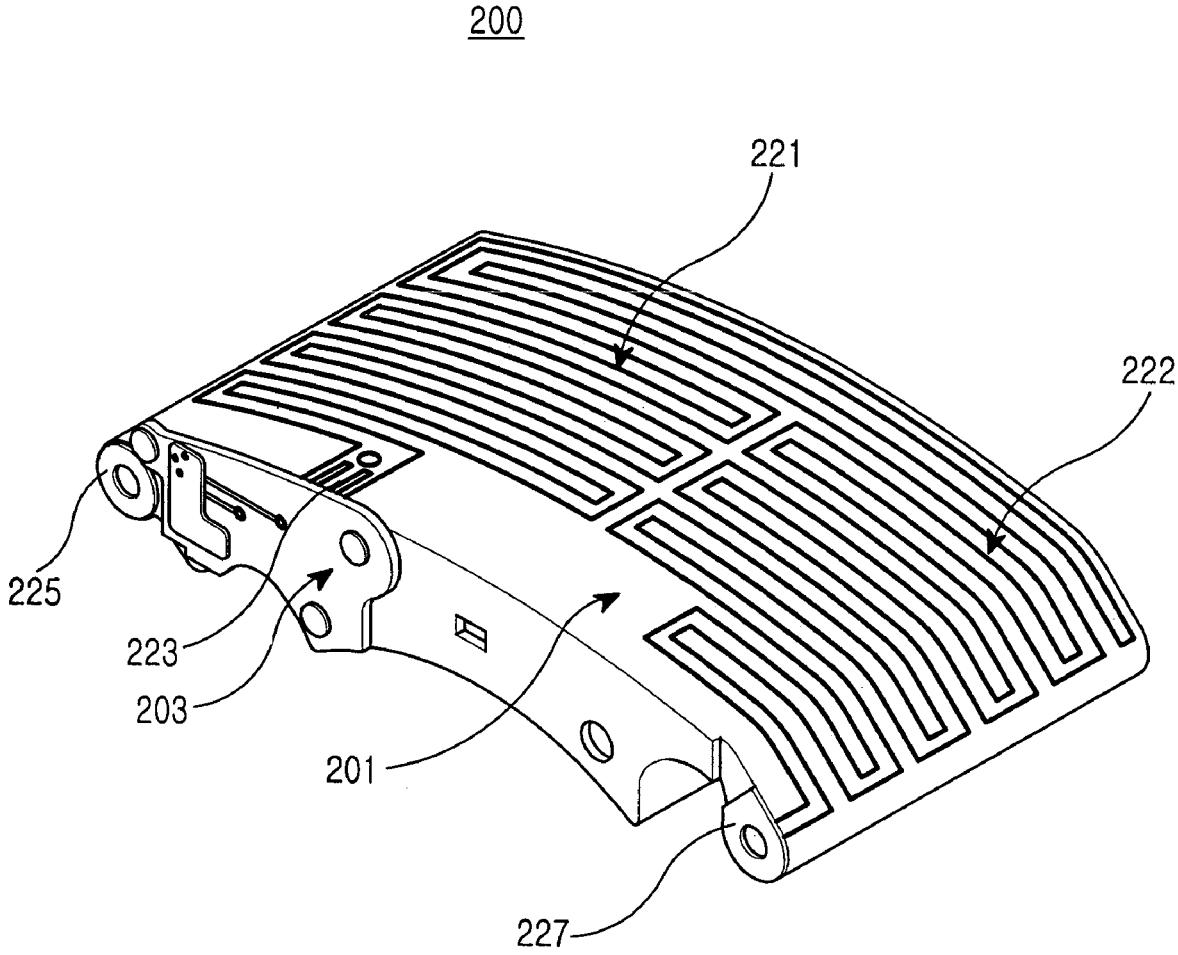
FIG. 4 is a perspective view showing the antenna of FIG. 2.

The construction of the antenna apparatus 200 is now described in detail with reference to FIGS. 4 to 6.

The antenna apparatus 200 is a divergent type antenna in which a first antenna pattern 221 and a second antenna pattern 222 are capacitively coupled. Antenna apparatus 200 has an antenna base 201 formed of a synthetic resin so as to configure the first and second antenna patterns 221 and 222.

The antenna base 201 is installed within the top portion of the housing of the terminal 10 so as to provide means for allowing the first and second antenna patterns 221 and 222 to be installed within the housing of the terminal 10 while maintaining their shapes.

A printed circuit board 203 is mounted on the front side of the antenna base 201, on which a power feed circuit 223 for the circuit board is formed. A ground 225 is provided at one end of the printed circuit board 203. Further, one end of the first antenna pattern 221 is connected to the power feed circuit 223 of the printed circuit board 203 to receive power from the circuit. One end of the second antenna pattern 222 is provided with a ground terminal 227, which is connected with a ground and is provided on the terminal 10 at the front side of the antenna base 203.

The first and second antenna patterns 221 and 222 are configured as meander line antennas, respectively, with one end of each antenna being connected with the power feed circuit and a ground and the other end of each antenna providing a capacitive coupling. The first antenna pattern 221 is formed in a zigzag shape in the crosswise direction for interconnecting one lateral end portion and the central portion of the antenna base 201 on one side of the antenna base 201. The entire length of the first antenna pattern 221 corresponds to one half of an operational wavelength for the terminal 10.

The second antenna pattern 222, similar to the first antenna pattern 221, is also formed in a zigzag shape in the crosswise direction for interconnecting the other lateral end portion and the central portion of the antenna base 201 on the one side of the antenna base 201. The entire length of the second antenna pattern 222 corresponds to one half of the operational wavelength for the terminal 10.

The shapes of the first and second antenna patterns 221 and 222 are established such that when the current flow, in the first antenna pattern 221, is directed to the one lateral end from the central part of the antenna base 203, the current flow in the second antenna pattern 222, which is in line with the current flow in the first antenna pattern 221, is also directed toward the other lateral end from the central part of the antenna base 203.

In addition, the shapes of the first and second antenna patterns 221 and 222 are established such that when the current flow in the first antenna pattern 221 is directed toward the central part of the antenna base 203, the current flow in the second antenna pattern 222, which is in line with the current flow in first antenna pattern 221, is also directed toward the central part of the antenna base 203.

Consequently, due to the configuration of the first and second antenna patterns 221 and 222, the antenna apparatus 200 is configured as a divergent type antenna. The directions of current flowing through the first and second antenna patterns 221 and 222 are opposite to each other depending on the positions of the antenna patterns 221 and 222, so that the electromagnetic waves generated by the currents flowing through the first and second antenna patterns 221 and 222 cancel each other out, thereby improving SAR.

Figure 5:
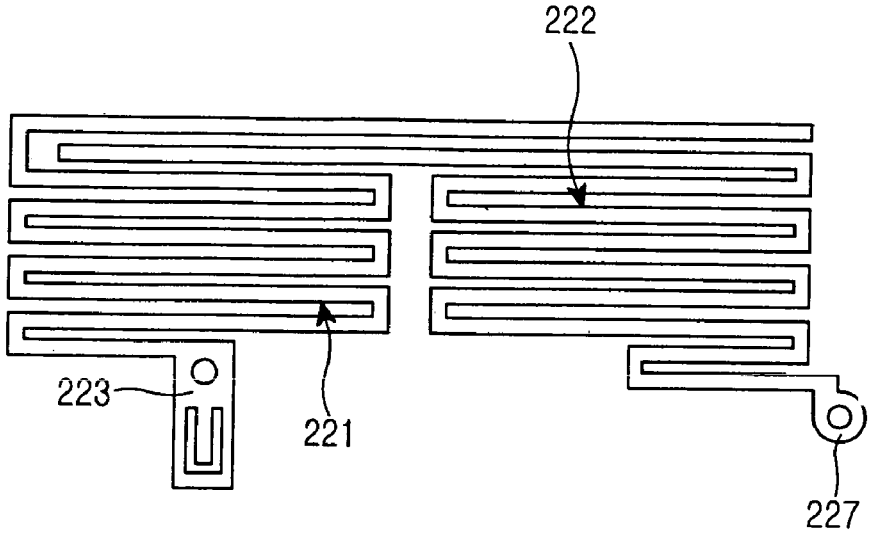
FIG. 5 is a top plan view showing antenna patterns of the antenna apparatus of FIG. 4.
Figure 6:
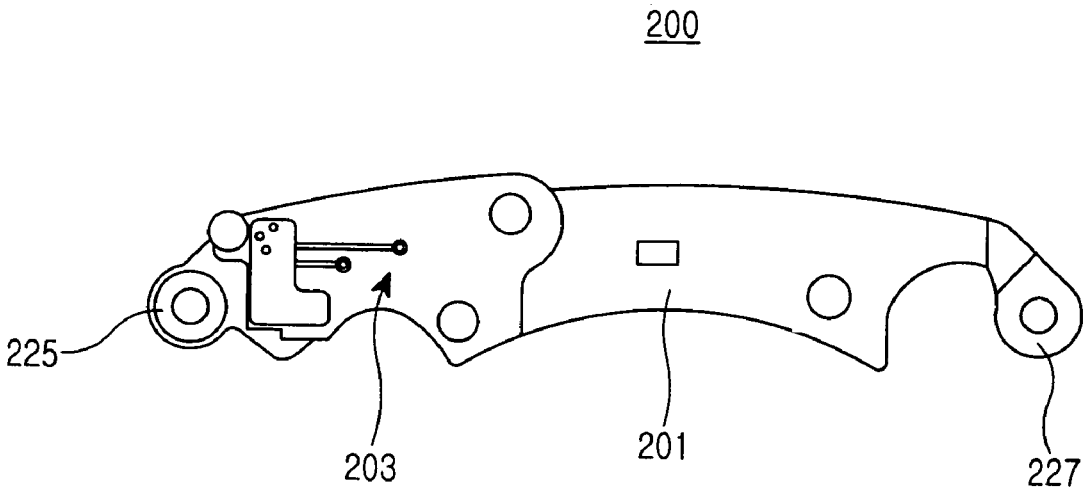
FIG. 6 is a front elevational view of the antenna apparatus of FIG. 4.

Meanwhile, as shown in FIG. 5, the other lateral end of the second antenna pattern 222 is surrounded by the other lateral end of the first antenna pattern 221, thereby providing a capacitive coupling. The capacitive coupling of the first and second antenna patterns 221 and 222 suppresses the generation of noise when the terminal 10 is in signal-transmitting or signal-receiving mode, thereby improving communication quality.

The characteristics of a conventional internal type antenna and the antenna apparatus 200, according to the exemplary embodiment of the present invention, will be compared below.

Table 1 below shows TIS/TRP values measured through phantom tests and SAR values measured through SAR tests for a conventional PIFA antenna and an antenna apparatus 200 according to the exemplary embodiment of the present invention.

TABLE 1

| Conventional PIFA Antenna | | | | Divergent Type Antenna | | |
|---|---|---|---|---|---|---|
| 363 CH | 779 CH | 1011 CH | Channel | 363 CH | 779 CH | 1011 CH |
| −92.9 dBm | −96.7 dBm | −97.8 dBm | TIS | −94.8 dBm | −98.6 dBm | −96.3 dBm |
| 15.4 dBm | 14.7 dBm | 13.4 dBm | TRP | 15.6 dBm | 14.9 dBm | 12.9 dBm |
| 2.07 dBm | 1.94 dBm | 1.77 dBm | SAR | 1.54 dBm | 1.3 dBm | 1.3 dBm |

Here, "TIS" is an abbreviation for "Total Isotropic Sensitivity," which is the sensitivity measured around a terminal and is used to ascertain the signal-receiving performance of the terminal. "TRP" is the abbreviation for "Total Radiated Power," which is the value of radiated power measured around a terminal and is used as a measurement for the general characteristic of the terminal.

As can be seen from the results of the experiment in Table 1, the PIFA antenna and the inventive antenna apparatus 200 exhibit similar performances in terms of TIS/TRP values measured through the phantom tests. However, in terms of SAR characteristic, when the inventive antenna apparatus is employed, the SAR characteristic is improved 25% over the conventional PIFA antenna.

As described above, the inventive antenna apparatus for a portable terminal is configured by a pair of meander antennas, which provide capacitive coupling, whereby it is easy to use the antenna apparatus within a terminal while suppressing the generation of noise. Furthermore, according to the exemplary embodiments of invention, it is easy to improve the SAR, which is an important factor for defining the performance and quality of an antenna apparatus.

While the invention has been shown and described with reference to certain embodiments thereof, it will be understood by those skilled in the art that various changes in form and details may be made therein without departing from the spirit and scope of the invention as defined by the appended claims.

What is claimed is:

1. An antenna apparatus for a portable terminal having a housing, the antenna comprising:

a first antenna pattern received in the housing of the portable terminal; and a second antenna pattern received in the housing of the portable terminal and adapted to be positioned corresponding to the first antenna pattern, such that at least part of the second antenna and the first antenna pattern are capacitively coupled;

wherein the directions of current flowing through at least a portion of the first antenna pattern and at least a portion of the second antenna pattern are opposite to each other such that electromagnetic waves generated by the current cancel each other out.

2. An antenna apparatus as claimed in claim 1, further comprising an antenna base received in the housing of the portable terminal, the first and second antenna patterns being formed on the antenna base.

3. An antenna apparatus as claimed in claim 2, further comprising a printed circuit board mounted on the antenna base, wherein the printed circuit board comprises a power feed circuit for the first antenna pattern.

4. An antenna apparatus as claimed in claim 1, wherein one end of the first antenna pattern is connected to the power feed circuit and one end of the second antenna pattern is connected to a ground.

5. An antenna apparatus as claimed in claim 4, wherein another end of the first antenna pattern is formed in a shape surrounding another end of the second antenna pattern, thereby providing the capacitive coupling.

6. An antenna apparatus as claimed in claim 1, wherein the first and second antenna patterns are each formed of a length corresponding to one half of an operational wavelength of the portable terminal.

7. An antenna apparatus as claimed in claim 1, wherein each of the first and second antenna patterns is formed as a meander line antenna.

8. An antenna apparatus for a portable terminal comprising:

a first antenna pattern; and a second antenna pattern adapted to correspond to the first antenna pattern, so that at least part of the second antenna and the first antenna pattern are capacitively coupled, thereby configuring a divergent type antenna with the second antenna pattern;

wherein each of the first and second antenna patterns is formed as a meander line antenna; and wherein the first antenna pattern is configured in a zigzag form for interconnecting one lateral end and a central part of an antenna base on one side of the antenna base, and the second antenna pattern is also configured in a zigzag form for interconnecting another lateral end and the central part on the one side of the antenna base.

9. An antenna apparatus as claimed in claim 8, wherein the first and second antenna patterns are established in such a way that when the current flow in the first antenna pattern is directed toward the one lateral end from the central part of the antenna base, the current flow in the second antenna pattern, which is in line with the current flow in the first antenna pattern, is also directed toward the another lateral end from the central part of the antenna base, and when the current flow in the first antenna is directed toward the central part of the antenna base, the current flow in the second antenna pattern, which is in line with the current flow in the first antenna pattern, is also directed toward the central part of the antenna pattern.

* * * * *